US006938349B2

(12) United States Patent
Afshari

(10) Patent No.: US 6,938,349 B2
(45) Date of Patent: Sep. 6, 2005

(54) BOW SIGHT WITH VERTICALLY ALIGNED PINS

(76) Inventor: Abbas Ben Afshari, P.O. Box 6005, Pocatallo, ID (US) 83205

( * ) Notice: Subject to any disclaimer, the term of this patent is extended or adjusted under 35 U.S.C. 154(b) by 71 days.

(21) Appl. No.: 10/435,943

(22) Filed: May 12, 2003

(65) Prior Publication Data

US 2004/0006879 A1 Jan. 15, 2004

Related U.S. Application Data

(63) Continuation-in-part of application No. 09/989,935, filed on Nov. 20, 2001, now Pat. No. 6,560,884, which is a continuation-in-part of application No. 09/991,243, filed on Nov. 20, 2001.

(51) Int. Cl.[7] ..... F41G 1/467
(52) U.S. Cl. ..... 33/265; 124/87
(58) Field of Search ..... 33/265; 124/87, 124/88

(56) References Cited

U.S. PATENT DOCUMENTS

| | | | | | |
|---|---|---|---|---|---|
| 2,574,599 | A | | 11/1951 | Stieber | |
| 3,310,875 | A | | 3/1967 | Kowolski | |
| 4,244,115 | A | | 1/1981 | Waldorf | |
| 4,385,448 | A | | 5/1983 | Burkey | |
| 4,584,777 | A | | 4/1986 | Saunders | |
| 4,984,373 | A | | 1/1991 | Forrest | |
| 5,103,568 | A | * | 4/1992 | Canoy | 33/265 |
| 5,231,765 | A | * | 8/1993 | Sherman | 33/265 |
| 5,379,746 | A | * | 1/1995 | Sappington | 124/87 |
| 5,419,303 | A | | 5/1995 | Stewart | |
| 5,435,068 | A | | 7/1995 | Thames et al. | |
| 5,560,113 | A | * | 10/1996 | Simo et al. | 33/265 |
| 5,638,604 | A | | 6/1997 | Lorocco | |
| 5,864,958 | A | | 2/1999 | Giddens | |
| 6,000,141 | A | * | 12/1999 | Afshari | 33/265 |
| 6,073,352 | A | * | 6/2000 | Zykan et al. | 33/265 |
| 6,418,633 | B1 | * | 7/2002 | Rager | 33/265 |
| 6,463,665 | B1 | * | 10/2002 | Gomez-Vazquez | 33/265 |
| 6,494,604 | B2 | * | 12/2002 | Khoshnood | 33/265 |
| 6,560,884 | B1 | * | 5/2003 | Afshari | 33/265 |
| 2002/0042999 | A1 | * | 4/2002 | Lorocco | 33/265 |
| 2002/0083602 | A1 | * | 7/2002 | Slates | 33/265 |
| 2004/0031162 | A1 | * | 2/2004 | Rager | 33/265 |

* cited by examiner

*Primary Examiner*—G. Bradley Bennett
(74) *Attorney, Agent, or Firm*—Morriss O'Bryant Compagni, P.C.

(57) ABSTRACT

A bow sight is comprised of at least two support structures, each support structure supporting a vertically oriented sight pin. Each support structure is adjustably attached to a mounting member that allows individual vertical adjustment of each support structure. The sight pins may be vertically aligned in an overlying manner to visually provide a single sight pin with multiple sight tips or horizontally aligned but vertically spaced to provide individually vertically adjustable sight tips.

27 Claims, 5 Drawing Sheets

BOW SIGHT WITH VERTICALLY ALIGNED PINS

CROSS-REFERENCE TO RELATED APPLICATIONS

This application is a continuation-in-part of and claims priority to U.S. patent application Ser. No. 09/989,935filed Nov. 20, 2001, now U.S. Pat. No. 6,560,884 and U.S. patent application Ser. No. 09/991,243 filed Nov. 20, 2001.

BACKGROUND OF THE INVENTION

1. Field of the Invention

This invention relates generally to sights for archery bows and, more specifically, to bow sights having sight pin constructions that are vertically aligned.

2. Description of the Art

Archery bow sights utilizing a plurality of sight pins have been known in the art for many years. Typically, these sights use a bracket or other mounting structure for mounting the sight to a bow. The sight is commonly comprised of a pin plate, a pin guard, and a plurality of sight pins which are secured to the pin plate and extend into a sight window formed by the pin guard. The sight is mounted to a bow in a manner so that when the bow string is drawn, the archer can look through a peep sight provided in the bow string and align the tip of a pin attached to the sight with a target. For sights utilizing a plurality of horizontally extending sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at 70 yards distance.

One such example of a bow sight is sold by Vital Bow Gear of Pocatello, Id. The bow sight is comprised of a pin plate, a pin guard and a sight window formed therebetween. A plurality of horizontally oriented sight pins are secured to the pin plate by screws, which engage the sight pins and extend through a slot formed in the pin plate. The sight pins extend transversely from the pin plate into the sight window. The bow sight is attached to various mounting brackets for attachment to the riser of a bow.

In use, the archer typically aligns a peep sight positioned on or formed in the bowstring with one of the sight pins 20. In order to properly sight in the sight to the bow (i.e., properly adjust sight pin to a particular distance from the target), each of the sight pins 20 is individually positioned and adjusted to correspond to a given distance (e.g., 20 yards, 40 yards, 60 yards, etc.) from the bow 12. The sight pins 20 allow the archer to better position the aim of the arrow to compensate for target distance and trajectory. Thus, the archer estimates his or her distance from a specific target (e.g., 20 yards) and utilizes the particular sight pin for that distance.

While some bow sights provide a single sight pin, as for use in target practice where the distance from the target does not change or in a tree stand scenario where bate is left at a particular distance from the hunter. Such single pin bow sights are incorporated into a pendulum arrangement and are commonly referred to as pendulum sights. Such pendulum sights are often used in conjunction with tree stands and the like where the hunter is positioned above the target and is aiming in a severely downward direction at the ground to animals below the hunter. In such a situation, the distance to target, while not fixed, is usually within a small range thus suited for a single pin sight arrangement.

One of the concerns of multiple pin bow sights that use horizontally oriented sight pins is that each sight pin that extends into the sight window provides a visual obstruction of the target. Thus, prior art sight pins have been designed to be relatively thin when viewed in the direction of aiming so as to produce the smallest visual obstruction possible.

One way of reducing the visual obstruction to the user is disclosed in copending patent application serial number U.S. patent application Ser. No. 09/989,935, now U.S. Pat. No. 6,560,884, herein incorporated by reference. In this patent, a single vertical sight pin includes multiple sight points. As such, a single vertical sight pin provides multiple sighting points while limiting visual obstruction to a single sight pin.

In copending U.S. patent application Ser. No. 09/991,243, herein incorporated by reference, a bow sight providing a single vertical sight pin is disclosed.

In U.S. Pat. No. 6,418,633 to Christopher A. Rager, a bow sight is provided with two or more vertically aligned vertical pins connected to the support structure. Each pin is provided with a different height, with the shortest pin positioned nearest the archer's eye so as to provide multiple visible sight tips when viewed by the archer when aiming the sight at a target. Each sight pin is vertically adjustable relative to the support structure so as to allow sighting of each sight pin for a particular distance-to-target. Because of the relative size of such sight pins, however, accurate adjustment of the height of such pins is difficult if not impossible.

Thus, it would be desirable, to provide a bow sight that provides a vertical pin arrangement where the relative height of each sight pin is easily and accurately adjustable. In addition, it would be desirable to provide a bow sight that provides a vertical pin arrangement where each sight pin is illuminated by a fiber optic element.

SUMMARY OF THE INVENTION

Accordingly, a bow sight is comprised of a plurality of support structures for supporting one vertically oriented sight pin on each support structure. Each support structure defines a sight window with the respective sight pin vertically oriented within the sight window. The plurality of support structure that comprise of single bow sight each provide respective sight pins of varying height, but are configured when stacked to vertically align each sight pin so that when viewed in an aiming direction, only the full front of the closest sight pin is visible and the remaining sight tips extend above the sight tip of the closest sight pin.

Each support structure is configured for attachment to and adjustment bracket that allows for individual vertical adjustment of each support structure. Because the sight pins are fixedly attached to their respective support structures, adjustment of the sight pins themselves is eliminated.

In one embodiment of the present invention the sight pins are integrally formed with their respective support structure.

In another embodiment, the support structures are generally cylindrical in shape.

In yet another embodiment, each sight tip of each sight pin is illuminated utilizing a segment of fiber optic material.

In still another embodiment, the fiber optic segment is wrapped at least partially around the exterior of its respective support structure so as to provide additional exposed surface area for gathering light.

In yet another embodiment, the support structure closest to the archer is covered with a high visibility material to make the front surface of the support structure more visible to the archer in low light conditions.

In still another embodiment, a channel is formed around the exterior of each support structure for containing a segment of luminescent material with a length of fiber optic material used for forming the sight tip of the sight pin disposed over the luminescent material.

In still another embodiment, a dampening material is disposed between each of the stacked support structures to prevent sound generation between adjacent rings that may be caused by vibrations in the bow while shooting.

The difference in height between adjacent vertically aligned sight pins may be calculated using conventional ballistic formulas. Such formulas can be found in an article entitled "Exterior Ballistics of Bows and Arrows" by W. J. Rheingans, herein incorporated by this reference. Thus, a set of support structure/sight pins can be provided for a particular bow speed and typical distances as a base point. To accommodate bows of different bow speeds or to adjust each sight pin for a different distance-to-target, however, the individual support structures can be independently vertically adjusted.

Of course, the sight pins of the present invention may be integrally formed with their respective support structure or may be a separate component that is mechanically attached to the support structure.

DETAILED DESCRIPTION OF THE INVENTION

Figure 1A:
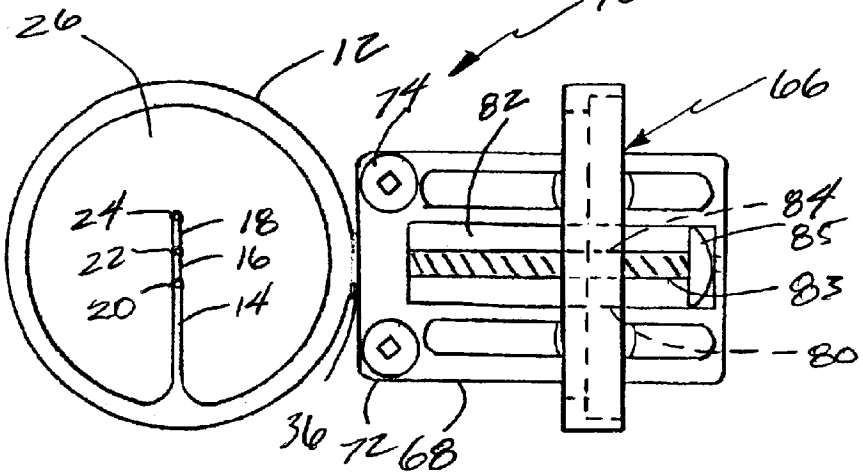
FIG. 1A is a front view of a first embodiment of a bow sight in accordance with the principles of the present invention.

FIG. 1A illustrates a vertical pin bow sight, generally indicated at 10 in accordance with the principles of the present invention. The sight 10 is comprised of a plurality of support structures (only one of which is visible) 12 or rings which define pin guards, each of which support a sight pin 14, 16 and 18. Each sight pin 14, 16, and 18 is provided with sighting indicia or a sight tip 20, 22 and 24, respectively. The sight pins 14, 16 and 18 are vertically aligned when viewed as shown in FIG. 1A so that while all of sight pin 14 is visible, the remaining sight pins 16 and 18 only have portions visible that include their respective sight tips 22 and 24 for viewing by the archer when aiming. By vertically aligning the sight pins 14, 16 and 18, obstruction of the sight window 26 defined by the pin guard 12 is minimized to that of the width of a single sight pin 18.

As shown, the sight pin 14 may be integrally formed with the support structure or pin guard 12 or may be formed from separate components attached together in various fashions. For example, as previously discussed herein, it is known in the art to provide a pin plate for supporting the sight pin with a pin guard, which protects the sight pin, attached to the pin plate. A similar arrangement could be readily adapted to result in a similarly constructed bow sight comprised of separately attached components to achieve the same general structure.

Figure 1B:
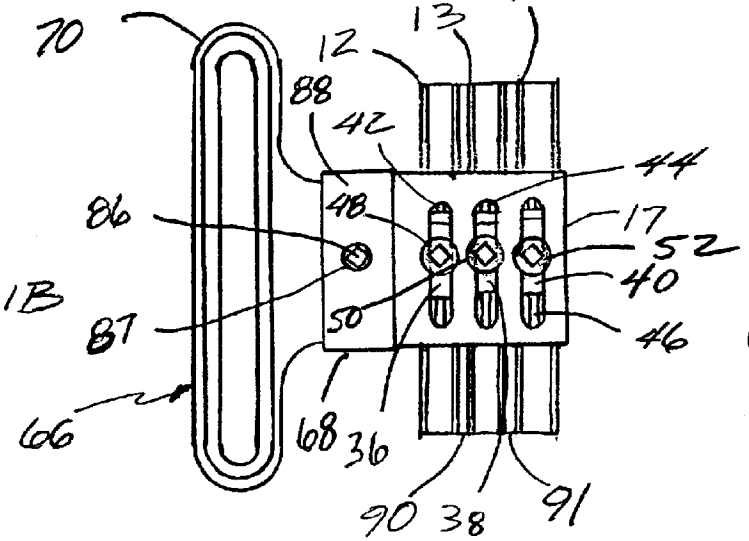
FIG. 1B is a side view of the bow sight illustrated in FIG. 1A.
Figure 1C:
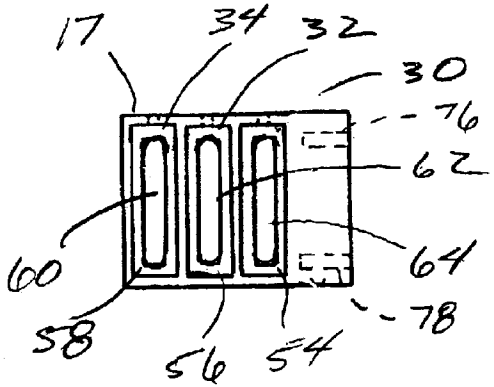
FIG. 1C is a side view of the adjustment bracket illustrated in FIG. 1B.

As shown in FIGS. 1B and 1C, each support structure 12, 13 and 15 is individually vertically adjustable relative to an adjustment bracket 17. The adjustment bracket 17 is provided with three elongate channels 30, 32 and 34, each of which is configured for receiving therein a mounting portion 36, 38 and 40, respectively, of the support structures 12, 13 and 15. Each mounting portion 36, 38 and 40 is generally rectangular in cross-section having a width that is slightly smaller than the width of its respective channel and a depth that is at least slightly larger than the depth of its respective channel. Thus, the mounting portions 36, 38 and 40 can be moved vertically within the adjustment bracket 17 but are prevented from rotating or tilting because of the abutting engagement with the channel.

Each mounting portion 36, 38 and 40 is threadedly engaged by an adjustment screw 42, 44 and 46, respectively, that extends the length of its respective channels 30, 32 and 34. Securing fasteners 48, 50 and 52 hold the respective mounting portions 36, 38 and 40 to the adjustment bracket 40 by threadedly engaging the mounting portions and holding the mounting portions against the inside surfaces 54, 56 and 58 of the channels 30, 32, and 34, respectively. The slots 60, 62 and 64 allow the securing fasteners 48, 50 and 52 to engage the adjustment bracket 17 over a range of positions to allow for vertical adjustment of the sight pins 14, 16 and 18.

The adjustment bracket 17 is further coupled to a windage adjustment mechanism 66 shown in FIGS. 1A and 1B. The windage adjustment mechanism provides for horizontal gang adjustment of the adjustment bracket 17 and associated support structures 12, 13 and 15. The windage adjustment mechanism 66 is comprised of two brackets including a second adjustment bracket 68 and a bow mounting bracket 70 for attaching to the riser of a bow (not shown). The second adjustment bracket 68 is mounted to the first adjustment bracket 17 with threaded fasteners 72 and 74 into threaded bores 76 and 78. The bow mounting bracket 70 is attached to the second adjustment bracket 68 in a similar fashion to the support structures 12, 13 and 15 are mounted to the first adjustment bracket 68. That is, the bow mounting bracket 70 includes a mounting portion 80 that fits within an elongate slot 82 formed in the second adjustment bracket 68. A threaded fastener 83 engages a threaded bore 84 that extends transversely through the mounting portion 80. The fastener 83 has a length that is only slightly smaller than the length of the channel 82 so as to substantially prevent movement of the fastener 83 in the direction of its longitudinal axis. The mounting portion 80 of the bracket 70 prevents substantial movement of the fastener 83 in a direction transverse to its longitudinal length. The head 85 of the fastener 83, and more particularly, the engaging feature 86 (in this example a square hole, but may also include hex head openings and the like) of the fastener 83 is engageable through a hole or bore 87 provided in the side 88 of the bracket 68. By rotating the fastener 83 with a tool (not shown) inserted through the opening 87, the bracket 70 is controllably moved relative to the adjustment bracket 68. When the bracket 70 is mounted to a bow, rotation of the fastener 83 causes a corresponding horizontal displacement of the sight 10 relative to the bow.

As shown in FIG. 1B, interposed between each support structure 12, 13 and 15 are vibration dampeners 90 and 91 that prevent the support structures 12, 13 and 15 from impacting one another due to vibration incurred when the bow is fired. The dampeners 90 and 91 effectively allow the separate support structures 12, 13 and 15 to be placed closely together to provide a relatively compact bow sight 10, while eliminating noise that may otherwise be generated if the support structures 12, 13 and 15 were allowed to vibrate against one another. Also, the dampeners 90 and 91 are essentially sandwiched between adjacent support structures 12, 13 and 15 to cause the individual support structures 12, 13 and 15 to essentially act as a single unit while still allowing for individual adjustment of the support structures 12, 13, and 15. Each dampener 90 and 91 is attached to one of the support structures so that during adjustment of the support structures 12, 13 and 15, the dampeners stay in place relative to at least one of the support structures 12, 13 and 15. By sandwiching the dampeners 90 and 91 between the support structures 12, 13 and 15 with no gaps between the support structures and the dampeners, vibrational noise between the dampeners and the support structures is also eliminated. When utilizing circular support structures as illustrated, the dampeners may be comprised of o-rings of a similar diameter or sections of o-ring material.

Figure 2A:
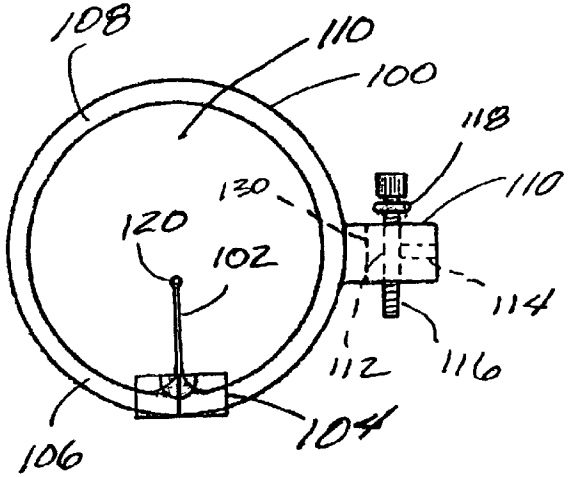
FIG. 2A is a front view of a sight pin/support structure in accordance with the principles of the present invention.

Referring now to FIG. 2A, there is illustrated one support ring 100 and associated sight pin 102 in accordance with the principles of the present invention. The support ring/sight pin assembly may be the ring/sight pin assembly closest to the archer when utilizing the sight with other rings in a manner illustrated in FIG. 1A. A bubble-type leveling device 104 is attached to the front surface 106 of the support ring 100 to provide a visual leveling guide for the user to ensure that the sight is as near level as possible when shooting. The front surface 106 is at least partially covered with a high visibility material or paint 108 so as to provide the user with a easily visible sight window 110, even in low light conditions. For example, the material or paint 108 may include an elongate strip of flourescent or glow-in-the-dark tape.

As previously discussed, the mounting portion or tab 110 is generally rectangular in cross section and length and is provided with a pair of threaded bores 112 and 114. The bore 112 extends transversely through the tab 110 for engaging with an adjustment screw 116 for vertical adjustment of the tab 110 relative to an adjustment bracket as illustrated in FIG. 1C. A dampener 118 in the form of an o-ring is positioned on the fastener and has a diameter that is slightly larger than the channel of the mounting bracket in which it is inserted to reduce vibration of the fastener 116 and or tab 110 within the channel. The second bore 114 is provided for securing the tab 110 to the adjustment bracket once the desired position of the tab 110 within the channel is obtained.

Figure 2B:
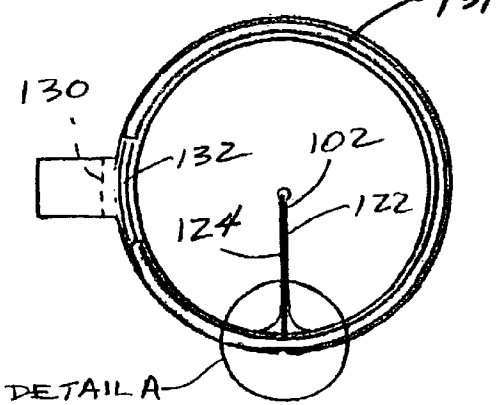
FIG. 2B is a back view of the sight pin/support structure illustrated in FIG. 2A.
Figure 2C:
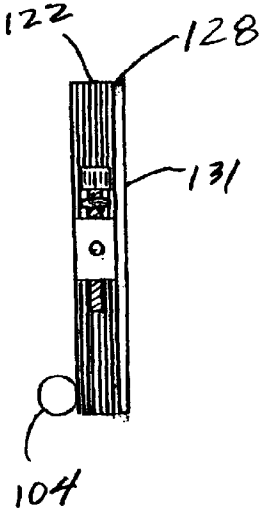
FIG. 2C is a side view of the sight pin/support structure illustrated in FIG. 2A.
Figure 2D:
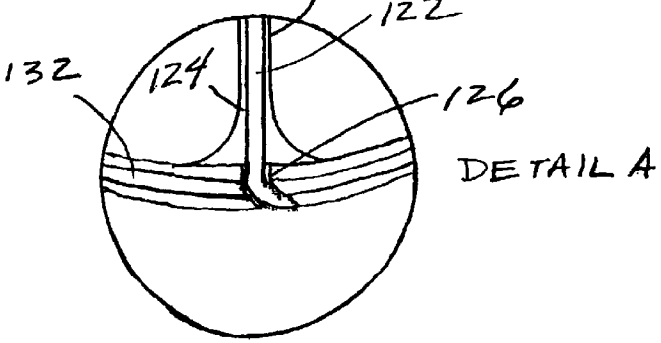
FIG. 2D is a detail view of the sight pin/support structure illustrated in FIG. 2B.

The sight pin 102 is provided with a fiber optic member which forms a sighting indicia or tip 120 at one of its terminal ends. As shown in FIG. 2B, the fiber optic member 122 (formed from an elongate plastic strand that may be colored with a desired color such as yellow, green, red, orange or the like), and as better shown in DETAIL A, extends along the back 124 of the sight pin 102. A slot 126 is provided at the base of the sight pin 102 to allow the fiber optic member 122 to be bent at least 90 degrees for wrapping around the exterior of the support structure 100.

To accommodate the fiber optic member 122, a channel 128 circumscribes the support structure 110 around its outer surface. The fiber optic member 122 is wrapped several times in the channel 128. A length of glow-in-the-dark tape or material may be placed beneath the fiber optic wrappings to help illuminate the sight tip 120 in low light conditions. As shown in FIGS. 2A and 2B, the fiber optic wrappings pass through a transversely extending opening to allow the wrappings to pass through the tab 110.

A dampening member 131 is adhesively attached to the support structure 100 and is partially inserted within a small channel 132 formed in the back surface of the support ring 100. The dampening member 131 partially encircles the support ring 100 to provide its dampening function over a substantial portion of the support ring 100.

Figure 3B:
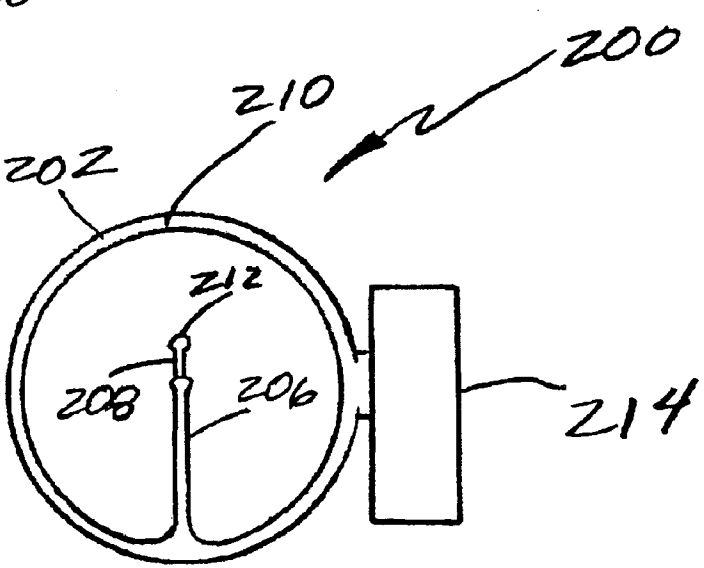
FIG. 3B is a front view of the bow sight illustrated in FIG. 3A.
Figure 3A:
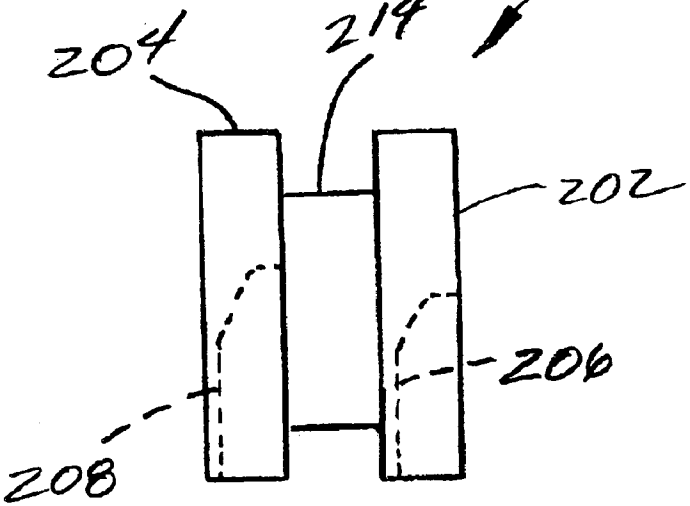
FIG. 3A is a side view of a second embodiment of a bow sight in accordance with the principles of the present invention

Referring now to FIGS. 3A and 3B, there is shown yet another embodiment of a bow sight, generally indicated at 200 in accordance with the principles of the present invention. The sight 200 is comprised of a pair of support structures 202 and 204 which support a pair of sight pins 206 and 208, respectively. The support structures 202 and 204 have similar diameters so as to present a single prominent surface 210 when viewed as shown in FIG. 3B. The sight pin 206 has a height that is less than the sight pin 208 to allow the sight tip 212 of the sigh pin 208 to be viewable behind the sight pin 206. The support structures 202 and 204 are independently mounted to a mounting member 214 that allows for individual vertical adjustment of the support structures 202 and 204 relative thereto.

Figure 4:
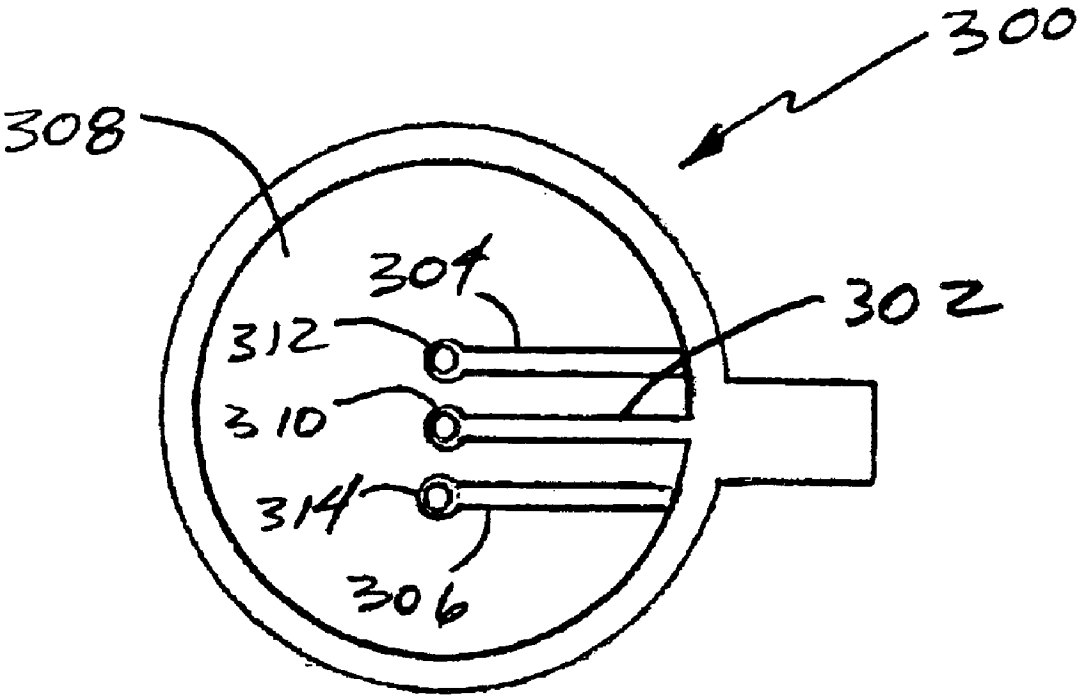
FIG. 4 is a front view of a third embodiment of a bow sight in accordance with the principles of the present invention.

As shown in FIG. 4, it is further contemplated that the principles of the present invention could be applied to a bow sight 300 having a horizontal pin arrangement in which the sight pins 302, 304 and 306 extend horizontally within the sight window 308 and are individually and independently vertically adjustable relative to one another. In such a case, each sight pin 302, 304, and 306 would have a similar length so that their respective sight tips 310, 312 and 314 would be in vertical alignment. Such an arrangement, however, would allow very closely positioned sight tips 310, 312 and 314 when viewed by the user when aiming because the physical structure of each sight pin 302, 304 and 306 would not interfere with close vertical positioning. That is, in a conventional bow sight where the sight pins are horizontally positioned relative to one another and they are all attached to the same support structure and individually adjustable relative thereto, the width of the sight pins themselves, particularly at their point of attachment, often limits the minimum distance possible between adjacent sight tips. The present invention in a horizontal arrangement eliminates this limitation.

Figure 5B:
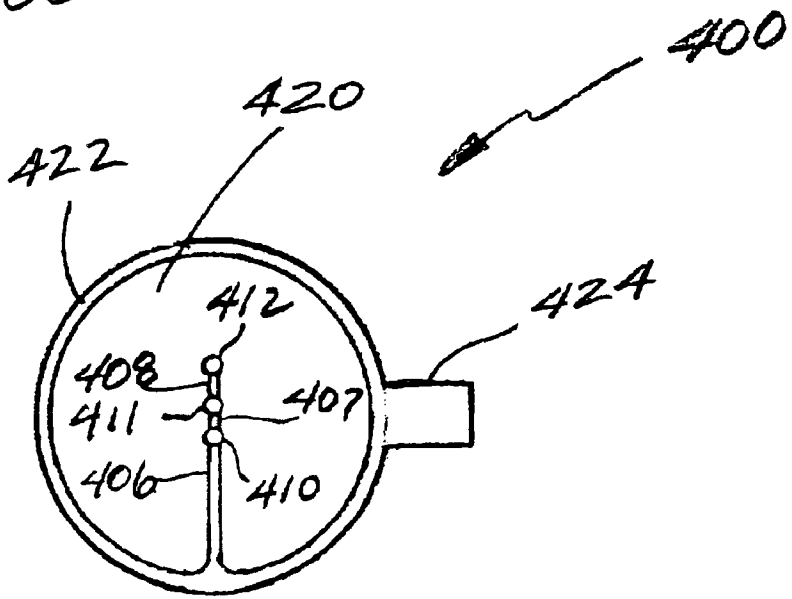
FIG. 5B is a front view of the bow sight illustrated in FIG. 5A.
Figure 5A:
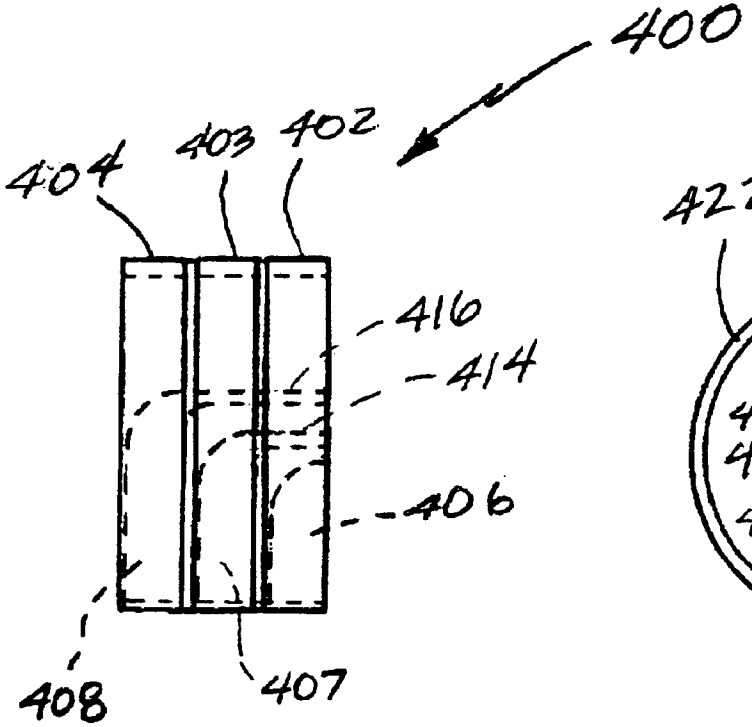
FIG. 5A is a side view of a fourth embodiment of a bow sight in accordance with the principles of the present invention.

FIGS. 5A and 5B illustrate yet another embodiment of a bow sight, generally indicated at 400 in accordance with the principles of the present invention. The support rings 402, 403 and 404 are similar in configuration to the support rings of the bow sight illustrated in FIGS. 1A and 1B. The sight pins 406, 407 and 408, however, are configured so that the sight tips 410, 411 and 412 are also in substantial vertical alignment when viewed from a direction shown in FIG. 5A. That is, the sight pins 407 and 408 include extension portions 414 and 416, respectively, with the extension portion 414 extending into the sight window 420 defined by the support ring 402 and the extension portion 416 extending into the sight window 420 defined by the support ring 402 while extending through the support ring 403. The proximal ends of the sight pins 407 and 408 terminate in substantial vertical alignment with the sight pin 406 as shown in FIG. 5A. By substantially vertically aligning the sight tips 410, 411 and 412 in a diametrically extending plane, extending along a plane defined by the sight pins 406, 407 and 408, as well as a plane defined by the face 422 of the support ring 402, aiming errors that may occur if the sight is tilted relative to the user about the attachment portion 424. When maintaining proper shooting form to ensure that the sight 400 is level during shooting (i.e., not tilted forward or backward), the sight pins of the bow sight 10 illustrated in FIG. 1, remain accurate aiming indicia. As the sight 10 is tilted by tilting of the top of the riser of the bow either toward or away from the user, the sight pins will appear either further apart or closer together depending upon the direction of the tilt. Such tilting will cause inaccurate targeting. By bringing the tips 411 and 412 of the back sight pins 407 and 408, respectively, forward, tilting of the sight relative to the user has a far less effect on targeting, ultimately resulting in more accurate shooting, even when the user is not maintaining proper form during shooting of the bow. Of course, while three sight pins have been illustrated, those of skill in the art will appreciate that more or fewer sight pins and associated support rings may be employed, with each sight pin behind the front sight pin 406 having an extension portion to provide a sight tip in substantial vertical alignment with the sight tip 410 in both vertical planes.

It should be noted that each sight pin is provided with a single aiming structure, such as a bead or the exposed end of a fiber optic element, provided on the "tip" of the sight pin. The term sight tip is thus commonly used to refer to this part of the sight pin that is used as the aiming reference. Each of the sighting tips of their respective sight pins are spaced in relative height when viewed by a user to provide the proper target or aiming reference for a particular distance-to-target. Thus, each of the sight tips represent a specific target distance (e.g., 20, 30, 40, 50 and 60 yards). Thus, while the present invention has been illustrated as having two or three ringed bow sights, additional ring/sight pin assemblies may be added to increase the number of sight pins for a given sight.

The bow sight pin/support structure assemblies of the present invention may be comprised of molded polycarbonate, machined aluminum components or any other lightweight materials known in the art. Thus, the sight may be formed from plastic, aluminum, or other materials known in the art and formed by various techniques known in the art. In addition, the pins and pin guard components may be separate components as previously described or integrally formed as by casting, molding or machining. Of course, those of skill in the art will appreciate that there may be other means and mechanisms of attaching the pins to the pin guard depending upon the configuration of the particular sight. Thus, by incorporating features of known bow sights and sight pins into the sight pin/pin guard arrangement of the present invention, the bow sight may take on various configurations. For example, it is not necessary for the pin guard to have a circular shape as there are numerous pin guard shapes known in the art that may be applied to the present invention. Moreover, while the present invention has been described with reference to the use of fiber optic elements, it is also contemplated that the sight indicia provided on each sight pin may by comprised of any material. For example, the sight pin may be formed from a brass element with the individual sight tips painted on the sight tip of the sight pin. Thus, it is not necessary to form the sight pin from any particular material so long as the sight tips or individual sighting indicia or indicators are separately visible by a user.

The bow sights according to the present invention are configured to be attached to virtually any preexisting bow configuration known in the archery industry by providing appropriate mounting hardware.

Accordingly, while the present invention has been described with reference to certain embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The claims provided herein are intended to cover such modifications and combinations and all equivalents thereof. Reference herein to specific details of the illustrated embodiments is by way of example and not by way of limitation.

What is claimed is:

1. A bow sight, comprising:

a first mounting structure;

a first pin guard coupled to said first mounting structure and vertically adjustable relative thereto;

a second pin guard coupled to said first mounting structure and vertically adjustable relative to said first mounting structure and independently vertically adjustable relative to said first pin guard;

a first sight pin fixedly mounted relative to said first pin guard; and a second sight pin fixedly mounted relative to said second pin guard;

whereby said first pin guard is positioned in front of said second pin guard when viewed in an aiming orientation.

2. The bow sight of claim 1, wherein said first sight pin lies in the same general plane as said first pin guard and said second sight pin lies in the same general plane as said second pin guard, said first and second pin guards defining a sight window with said first and second sight pins positioned within said sight window.

3. The bow sight of claim 1, wherein said first and second sight pins depend vertically from their respective first and second pin guards and wherein said first sight pin is visually in front of said second sight pin when viewed by a user.

4. The bow sight of claim 1, wherein said first and second sight pins depend horizontally from their respective first and second pin guards and wherein said first and second sight pins provide first and second sight tips that are in substantially vertical alignment.

5. The bow sight of claim 1, further comprising a first fiber optic member providing a sight indicia for said first sight pin and a second fiber optic member providing a sight indicia for said second sight pin.

6. The bow sight of claim 5, wherein said first fiber optic member extends from proximate a sight tip of said first sight pin, along a length of said first sight pin, and is wrapped at least partially around said first support structure and said second fiber optic member extends from proximate a sight tip of said second sight pin, along a length of said second sight pin, and is wrapped at least partially around said second support structure.

7. The bow sight of claim 6, further comprising a first glow-in-the-dark material disposed between said first fiber optic member and said first pin guard and a second glow-in-the-dark material disposed between said second fiber optic member and said second pin guard.

8. The bow sight of claim 1, wherein said first and second pin guards are generally cylindrical in shape.

9. The bow sight of claim 1, further comprising a first adjustment member coupled to said first mounting member and said first pin guard for providing vertical adjustment of said first pin guard relative to said mounting member and a second adjustment member coupled to said mounting member and said second pin guard for providing vertical adjustment of said second pin guard relative to said mounting member.

10. The bow sight of claim 1, further comprising a second mounting member adjustably coupled to said first mounting member for providing horizontal adjustment of said first mounting member relative to said second mounting member.

11. The bow sight of claim 1, further including a third pin guard coupled to said first mounting structure and vertically adjustable relative to said first mounting structure and independently vertically adjustable relative to said first and second pin guards and a third sight pin fixedly mounted relative to said third pin guard.

12. The bow sight of claim 1, further comprising a dampening member interposed between said first and second pin guards for reducing vibrational noise by said first and second support structures.

13. The bow sight of claim 1, further comprising a high visibility material disposed on at least a portion of a front surface of said first pin guard.

14. The bow sight of claim 1, wherein said second sight pin includes a second sight tip that is in substantial vertical alignment in at least two vertical planes with a first sight tip of said first sight pin.

15. The bow sight of claim 11, wherein said third sight pin includes a third sight tip that is in substantial vertical alignment in at least two vertical planes with a first sight tip of said first sight pin.

16. A bow sight, comprising:

at least one mounting structure;

a plurality of support structures coupled to said at least one mounting structure, each of said plurality of support structures, each comprising a pin guard that at least partially encompasses its respective sight pin for protecting each of the plurality of sight pins and each being independently vertically adjustable relative to one another and said at least one mounting structure; and a plurality of sight pins, at least one sight pin fixedly attached to each of said support structures.

17. The bow sight of claim 16, wherein said plurality of sight pins depend vertically from their respective support structure and wherein said plurality of sight pins are vertically aligned when viewed in an aiming orientation by a user.

18. The bow sight of claim 16, wherein said plurality of sight pins depend horizontally from their respective support structure and wherein said plurality of sight pins each provide a sight tip that is in substantially vertical alignment.

19. The bow sight of claim 16, further comprising a plurality of fiber optic members, each providing a sight indicia for each of said plurality of sight pins.

20. The bow sight of claim 19, wherein said plurality of fiber optic members each extends from proximate a sight tip of a respective sight pin, along a length of said respective sight pin, and is wrapped at least partially around a respective support structure.

21. The bow sight of claim 20, further comprising a plurality of glow-in-the-dark members disposed between each of said plurality of fiber optic members and their respective support structure.

22. The bow sight of claim 16, wherein each of said plurality of support structures are generally cylindrical in shape.

23. The bow sight of claim 16, further comprising a plurality of adjustment members, each coupled to said at least one mounting structure and to each of said plurality of support structures for providing vertical adjustment of each of said plurality of support structures relative to said at least one mounting structure.

24. The bow sight of claim 16, further comprising at least one mounting assembly adjustably coupled to said at least one mounting structure for providing horizontal adjustment of said at least one mounting structure relative to said at least one mounting assembly.

25. The bow sight of claim 16, further comprising a plurality of dampening members, at least one of which is interposed between each of said plurality of support structures for reducing vibrational noise between said plurality of support structures.

26. The bow sight of claim 16, further comprising a high visibility material disposed on at least a portion of a front surface of a first support structure of said plurality of support structures.

27. The bow sight of claim 16, wherein each of said plurality of sight pins defines a sight tip, each sight tip of said plurality of sight pins being in substantial vertical alignment in at least two vertical planes.

* * * * *